US005670849A

United States Patent [19]

Melai

[11] Patent Number: 5,670,849

[45] Date of Patent: Sep. 23, 1997

[54] CIRCUIT ARRANGEMENT

[75] Inventor: Henri A. I. Melai, Eindhoven, Netherlands

[73] Assignee: U.S. Philips Corporation, New York, N.Y.

[21] Appl. No.: 669,067

[22] Filed: Jun. 24, 1996

[30] Foreign Application Priority Data

Jun. 29, 1995 [EP] European Pat. Off. ..... 95201771

[51] Int. Cl.[6] ..... G05F 1/00

[52] U.S. Cl. ..... 315/307; 315/224; 315/209 R; 315/DIG. 7

[58] Field of Search ..... 315/307, 224, 315/209 R, 243, DIG. 5, DIG. 7; 363/109, 131, 97

[56] References Cited

U.S. PATENT DOCUMENTS

| | | | |
|---|---|---|---|
| 4,887,007 | 12/1989 | Almering et al. | 315/243 |
| 4,952,842 | 8/1990 | Bolhuis et al. | 315/106 |
| 4,965,493 | 10/1990 | Van Meurs et al. | 315/224 |
| 5,075,599 | 12/1991 | Overgoor et al. | 315/224 |
| 5,075,602 | 12/1991 | Overgoor et al. | 315/307 |
| 5,198,726 | 3/1993 | Van Meurs et al. | 315/224 |
| 5,198,728 | 3/1993 | Bernitz et al. | 315/307 |

FOREIGN PATENT DOCUMENTS

| | | |
|---|---|---|
| 0430358A1 | 6/1991 | European Pat. Off. . |
| 3910738A1 | 10/1990 | Germany . |

*Primary Examiner*—Robert Pascal
*Assistant Examiner*—Haissa Philogene
*Attorney, Agent, or Firm*—Edward Blocker

[57] ABSTRACT

The invention relates to a circuit arrangement for operating a lamp (LA), comprising means X for generating a current of alternating polarity, a load branch B coupled to the means X and provided with a series circuit Y comprising terminals (K1, K2) for holding the lamp, which terminals are connected by means of first capacitive means C1, and a current sensor SE means I coupled to current sensor SE and to the means X for controlling the power consumed by the lamp. According to the invention, the circuit arrangement in addition comprises a branch C which shunts the series circuit Y and which comprises a series arrangement of second capacitive means C2 and an impedance R2, the dimensioning of the circuit arrangement being chosen such that the ratio of the impedance value of the impedance R2 to the impedance value of current sensor SE is the same as the ratio of the amplitude of the current through the first capacitive means at least in one polarity direction to the amplitude of the current through branch C during lamp operation, and means II which form part of the means I and are coupled to current sensor SE and impedance R2 for generating a signal which is a measure for a difference between the voltage across current sensor SE and the voltage across impedance R2. This signal forms a comparatively accurate measure for the lamp current over a wide range of powers consumed by the lamp.

20 Claims, 3 Drawing Sheets

CIRCUIT ARRANGEMENT

Figure 1:
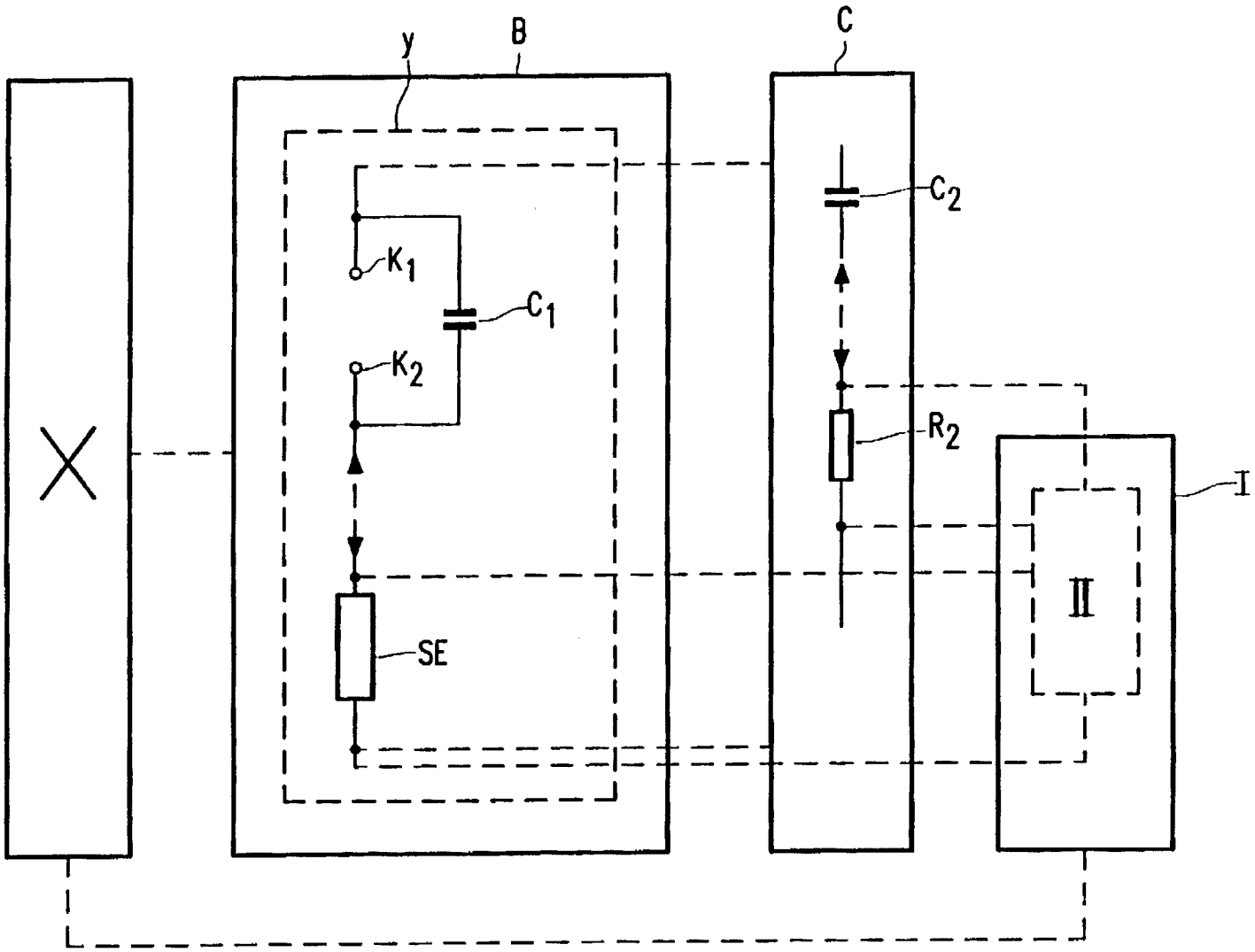

The invention relates to a circuit arrangement for operating a lamp, comprising means X for generating a current of alternating polarity, a load branch B coupled to the means X and provided with a series circuit Y comprising terminals for holding the lamp, which terminals are connected by means of first capacitive means C1, and a current sensor SE means I coupled to current sensor SE and to the means X for controlling the power consumed by the lamp.

Such a circuit arrangement is known from EP 0 430 358 A1. The first capacitive means in the known circuit arrangement are necessary for igniting the lamp. The power consumed by the lamp is controlled in that the means I influence the means X in dependence on the amplitude of the current through the sensor SE such that the maximum amplitude of the current through the sensor SE has a substantially constant value. Since the relation between the current through the lamp and the power consumed by the lamp is usually unequivocal over a wide range, it is possible to control the power consumed by the lamp through a control of the current through the lamp. However, if the circuit arrangement is also provided with, for example, means for dimming the lamp, a substantial portion of the current through the sensor SE flows through the first capacitive means when the lamp is operating in the dimmed state, so that the current through the sensor is not a good measure for the current through the lamp. As a result, it is not possible to control the power consumed by the lamp over a wide range by means of the known circuit arrangement.

It is an object of the invention to provide a circuit arrangement with which the power consumed by the lamp can be accurately controlled over a wide range.

According to the invention, a circuit arrangement as mentioned in the opening paragraph is for this purpose characterized in that the circuit arrangement in addition comprises a branch C which shunts the series circuit Y and which comprises a series arrangement of second capacitive means C2 and an impedance R2, the dimensioning of the circuit arrangement being chosen such that the ratio of the impedance value of the impedance R2 to the impedance value of current sensor SE is the same as the ratio of the amplitude of the current through the first capacitive means at least in one polarity direction to the amplitude of the current through branch C during lamp operation, and means II which form part of the means I and are coupled to current sensor SE and impedance R2 for generating a signal which is a measure for a difference between the voltage across current sensor SE and the voltage across impedance R2.

The impedance values of the components of series circuit Y and branch C are chosen such that the current through the first capacive means is substantially in phase with the current through branch C during lamp operation. The current through the first capacitive means C1 in series circuit Y being denoted I1 and the current in branch C being denoted I2, it is true that the voltage across impedance R2 is equal to I2 times the impedance value R2. As was indicated above, it is also true that $I2=\delta*11$ and impedance value R2=impedance value of current sensor SE/$\delta$, where $\delta$ is the ratio of the current in branch C to the current through the first capacitive means. Substitution thereof yields that the voltage across impedance R2 is equal to the voltage across the current sensor SE if a current flows through this current sensor which is equal to the current flowing through the first capacitive means C1. In fact, a current flows through current sensor SE which is equal to the sum of the current through the lamp and the current through the first capacitive means C1. The signal generated by the means H, which is a measure for the difference between the instantaneous value of the voltage across current sensor SE and the instantaneous value of the voltage across impedance R2, therefore, is a measure for that portion of the current in load branch B which is formed by the lamp current. It is possible to utilize the signal generated by the means II directly in that the lamp current is set in dependence on the amplitude of this signal after a fixed time interval in each cycle of the lamp current. The means I may alternatively be provided with means for generating a further signal which is a measure for an average value of the lamp current in that a time-averaged value of the signal generated by the means II is generated. The lamp current may be controlled in dependence on the further signal in that case. A control of the power consumed by the lamp has thus been realized by simple means whereby the power consumed by the lamp can be accurately controlled over a wide range.

It is noted here that German Patent DE-OS 39 10 738 A1 shows a circuit arrangement which comprises a lamp shunted by a capacitor. The circuit arrangement also comprises a transformer with two primary windings and a secondary winding. The primary windings are included in the circuit arrangement such that a first primary winding passes a current during lamp operation which is the sum of the lamp current and the current through the capacitor. A second primary winding passes exclusively the current through the capacitor. As a result, a voltage is present across the secondary winding which is a measure for the current through the lamp during lamp operation. This voltage may be used as a signal for controlling the power consumed by the lamp at a substantially constant level. A disadvantage is, however, that the transformer used is comparatively expensive and voluminous.

The current sensor SE and the impedance R2 in a circuit arrangement according to the invention may be of a comparatively inexpensive and simple construction, i.e. may be ohmic resistors.

The means X may comprise, for example, a bridge circuit. In that case the means X comprise a series circuit of two switching elements which are rendered conducting and non-conducting alternately for generating the current of alternating polarity. The load branch B usually shunts one of the switching elements. If the circuit arrangement comprises an incomplete half bridge, the series circuit Y may comprise, depending on the configuration of the load branch, third capacitive means C3 which are partly charged and discharged consecutively during each cycle of the current of alternating polarity. The capacitance value of these third capacitive means is such that they provide a negligible contribution to the total impedance of series circuit Y. It is advantageous in general, however, for the series circuit Y to comprise no further components in addition to the first capacitive means C1 and the current sensor SE. It is achieved in that way that branch C and series circuit Y are built up from mutually corresponding impedances so that the relation between the impedance of branch C and the impedance of series circuit Y changes comparatively little over a wide temperature range. Also if series circuit Y comprises no further components, the current through the first capacitive means will usually flow at least through one lamp electrode. It is advantageous for this reason if branch C is in addition provided with an ohmic resistor R3. The ohmic resistor R3 in this case forms a "corresponding impedance" in branch C for the impedance of the electrode in series circuit Y.

Figure 2:
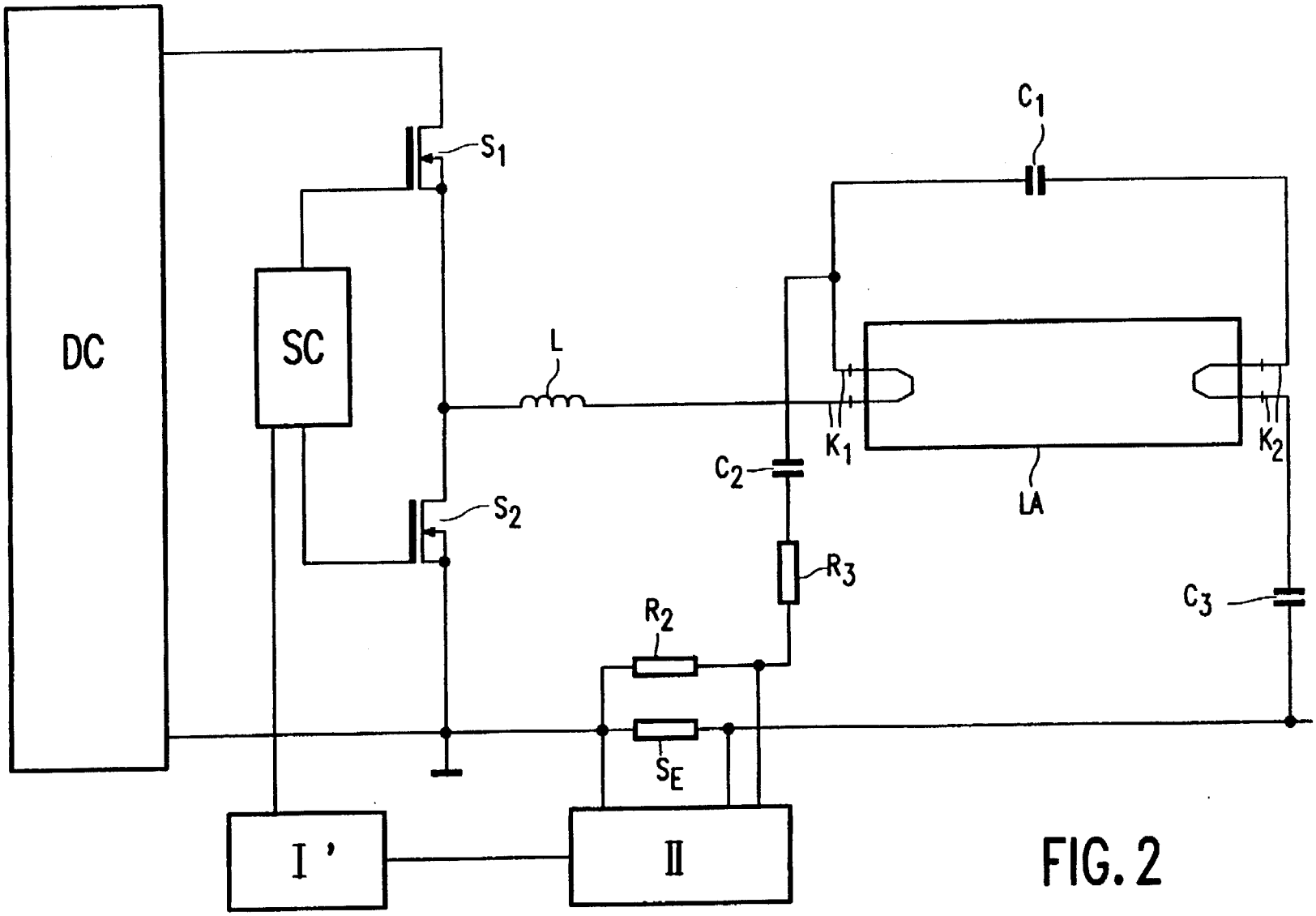
Figure 3:
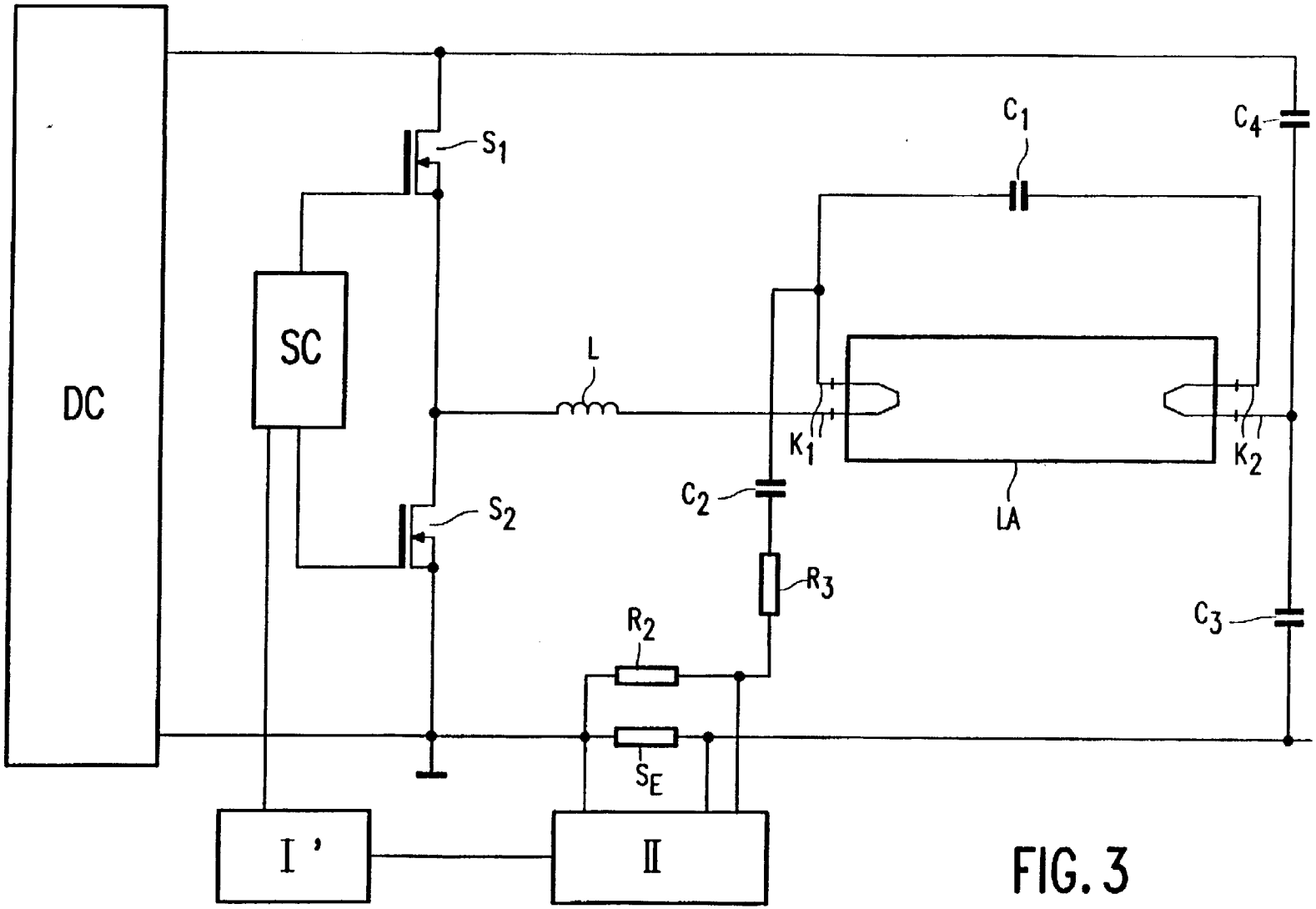

Embodiments of the circuit arrangement according to the invention are shown in a drawing, in which FIG. 1 is diagram of an embodiment of a circuit arrangement according to the invention with a lamp connected thereto;

FIG. 2 shown an embodiment of a circuit arrangement according to the invention in more detail, with a lamp LA connected thereto; and FIG. 3 shows an embodiment of a circuit arrangement according to the invention, again in more detail, with a lamp LA connected thereto.

In FIG. 1, X are means for generating current of alternating polarity. The means X are coupled to a load branch B which is provided with a series circuit Y comprising terminals K1 and K2 for holding a lamp, which terminals are interconnected by first capacitive means C1, and a current sensor SE. The current sensor SE is coupled to means I for controlling the power consumed by the lamp. The means I are also coupled to the means X. A branch C shunts the series circuit Y and comprises a series arrangement of second capacitive means C2 and an impedance R2. Branch C, impedance R2, and current sensor SE are so dimensioned that the ratio of the impedance value of the impedance R2 to the impedance value of current sensor SE is the same as the ratio of the amplitude of the current through the first capacitive means to the amplitude of the current through branch C during lamp operation. The means I comprise means II coupled to current sensor SE and impedance R2 for generating a signal which is a measure for a difference between the voltage across current sensor SE and the voltage across impedance R2. All couplings between circuit portions are indicated with broken lines.

The operation of the circuit arrangement shown in FIG. 1 is as follows.

When a lamp is connected to the terminals K1 and K2 and the circuit arrangement is operating, the means X generate a current of alternating polarity. As a result of this, a first current flows through the lamp and a second current flows through the first capacitive means C1. The sum of the first and second currents flows through the sensor SE. The current through branch C is substantially in phase with the current through the first capacitive means during lamp operation. As a result of the dimensioning of the circuit arrangement described above, the amplitude of the voltage across impedance R2 is equal to the amplitude of the voltage across the current sensor SE, at least in one polarity direction, if this latter sensor were to pass a current equal to the second current. The means II generate a signal which is a measure for a difference between the voltage across the current sensor SE and that across the impedance R2. As a result, this signal is a measure for the first current, i.e. the lamp current. The means I may in addition be provided, for example, with means (not shown) for generating a signal which is a measure for a desired lamp current value, and with means for generating a further signal which is a measure for an average lamp current value through generation of a time-averaged value of the signal generated by means II. The lamp current, and thus the power consumed by the lamp is controlled at a substantially constant level by means of the two signals and by means of the coupling between means I and means X.

In FIG. 2, DC form means for generating a DC voltage from a supply voltage. Respective output terminals of means DC are coupled to a first end and a second end of a series arrangement of switching element S1 and switching element S2. Control electrodes of switching element S1 and switching element S2 are coupled to respective outputs of control circuit SC for generating a signal for rendering switching element S1 and switching element S2 alternately conducting and non-conducting. Means DC, control circuit SC, and switching elements S1 and S2 in this embodiment form means X for generating a current of alternating polarity. A junction point of switching elements S1 and S2 is connected to a first end of coil L. A further end of coil L is connected to terminal K1. Terminal K1 is connected to a first end of the lamp LA. A further end of the lamp LA is connected to a second terminal K2, and the lamp is shunted by capacitor C1 which in this embodiment forms first capacitive means. Terminals K1 and K2 in this embodiment each comprise a first part which connects a first end of a lamp electrode to a side of the capacitor C1 and a second part which connects a further end of the lamp electrode to the remaining components of the load branch. The first part and the second part of each terminal are mutually electrically insulated. Terminal K2 is connected to a first side of capacitor C3, which in this embodiment forms third capacitive means C3. A further side of capacitor C3 is connected to a first end of current sensor SE which in this embodiment is formed by an ohmic resistor. A further end of current sensor SE is connected to the first end of the series circuit of switching element S1 and switching element 82. Coil L, terminals K1 and K2, lamp LA, capacitors C1 and C3, and current sensor SE together form load branch B. A junction point of capacitor C1 and terminal K1 is connected to a first side of capacitor C2 which in this embodiment forms second capacitive means. A further side of capacitor C2 is connected to a first side of ohmic resistor R3. Ohmic resistor R3 forms an impedance in branch C which corresponds to the electrode of lamp LA in series circuit Y through which the current through capacitor C1 flows. A further side of ohmic resistor R3 is connected to a first side of impedance R2. A further side of impedance R2 is connected to the first end of the series circuit of switching element S1 and switching element S2. Impedance R2 in this embodiment was chosen to be an ohmic resistor. Capacitor C2, ohmic resistor R3, and impedance R2 in this embodiment together form branch C. The first ends of impedance R2 and current sensor SE are connected to respective inputs of means H for generating a signal which is a measure for a difference between the voltage across current sensor SE and the voltage across impedance R2. The respective further ends of current sensor SE and impedance R2 are connected to a further input of the means II. An output of the means II is connected to means I' for keeping the power consumed by the lamp LA substantially constant with the aid of the signal generated by the means H. An output of the means I' is for this purpose connected to an input of the control circuit SC. Means I' and means II in this embodiment together form means I for controlling the power consumed by the lamp.

The operation of the embodiment shown in FIG. 2 is as follows.

When the means DC are connected to a supply voltage source via terminals which are not shown, the means DC generate a DC voltage, and the switching elements S1 and S2 are rendered conducting and non-conducting alternately by the control circuit SC, so that a current of alternating polarity flows through the load branch. The impedance values of the components in series circuit Y and branch C are chosen such that the current through the first capacitive means and the current through branch C are substantially in phase. The circuit arrangement is in addition so dimensioned that the ratio of the impedance value of impedance R2 to the impedance value of current sensor SE is the same as the ratio of the amplitude of the current in the first capacitive means to the amplitude of current in branch C. Ohmic resistor R3 is chosen such that the ratio of the impedance value of ohmic resistor R3 to the impedance value of ohmic resistor R2 is the same as the ratio of the impedance value of a lamp electrode to the impedance value of current sensor SE. Ohmic resistor R3 forms a "corresponding impedance" in branch C in relation to the impedance of the electrode in series circuit Y. The means II generate a signal which is a measure for a difference between the voltage across current sensor SE and the voltage across impedance R2. Owing to the dimensioning of the circuit arrangement described above, this signal is also a measure for the amplitude of the current through the lamp. In dependence on this signal, the frequency and/or conduction period of the switching elements S1 and S2 are so adjusted by the means I' via the control circuit that the power consumed by the lamp remains substantially constant. The embodiment of a circuit arrangement according to the invention shown in FIG. 2 comprises a bridge circuit of the incomplete half-bridge type. In practice, such a bridge circuit is dimensioned such that capacitor C3 provides only a small contribution to the total impedance of series circuit Y compared with capacitor C1. The reliability of the power control over a wide temperature range may be improved, however, in that capacitor C3 is placed, for example, between coil L and a junction point of switching elements S1 and S2, so that branch C and series circuit Y comprise exclusively mutually corresponding components.

The embodiment shown in FIG. 3 differs from the embodiment shown in FIG. 2 in that fourth capacitive means are present, formed by capacitor C4 which connects the second end of the series circuit of switching element S1 and switching element S2 to terminal K2. During the half cycle in which the current through the lamp and the current through capacitor C1 charge the capacitor C3, a portion of these currents also flows through capacitor C4 in this embodiment. Accordingly, the current through the current sensor SE is equal to the sum of the current through the first capacitive means and the lamp current only during those half cycles of the lamp current in which switching element S2 is conducting. The dimensioning of this embodiment is chosen such that the ratio of the impedance value of impedance R2 to the impedance value of current sensor SE is the same as the ratio of the amplitude of the current in the first capacitive means to the amplitude of current in branch C during that half cycle of the current in the load branch in which this current flows through the switching element 52.

The operation of the embodiment shown in FIG. 3 is as follows.

The means II generate a signal which is a measure for a difference between the voltage across current sensor SE and the voltage across impedance R2 during that half cycle of the current through the lamp in which the switching element S2 is conducting. On account of the dimensioning of the circuit arrangement as described above, this signal is also a measure for the amplitude of the lamp current. By means not shown in FIG. 3, the generation of this signal is suppressed during the other half cycle of the lamp current. In dependence on this signal, the frequency and/or the conduction time of the switching elements S1 and S2 are adjusted by the means I' via the control circuit such that the power consumed by the lamp remains substantially constant.

In a practical realization of a circuit arrangement according to the invention as shown in FIG. 2 for operating a low-pressure mercury discharge lamp with a power rating of approximately 15 W, the dimensionings of branch C and series circuit Y were chosen as follows:

C1=3,9 nF
C2=39 pF
C3=220 nF
SE=1 Ω
R2=100 Ω
R3=2,4 kΩ

The impedance of each lamp electrode was approximately 25 Ω. It was found to be possible with this dimensioning to adjust the lamp power over a wide range (25% to 100% of the nominal value) and to maintain this consumed power at a substantially constant level.

I claim:

1. A circuit arrangement for operating a lamp, comprising means X for generating a current of alternating polarity, a load branch B coupled to the means X and provided with a series circuit Y comprising terminals for holding the lamp, which terminals are connected by means of first capacitive means C1, and a current sensor SE means I coupled to current sensor SE and to the means X for controlling the power consumed by the lamp, characterized in that the circuit arrangement in addition comprises a branch C which shunts the series circuit Y and which comprises a series arrangement of second capacitive means C2 and an impedance R2, the dimensioning of the circuit arrangement being chosen such that the ratio of the impedance value of the impedance R2 to the impedance value of current sensor SE is the same as the ratio of the amplitude of the current through the first capacitive means at least in one polarity direction to the amplitude of the current through branch C during lamp operation, and means II which form part of the means I and are coupled to current sensor SE and impedance R2 for generating a signal which is a measure for a difference between the voltage across current sensor SE and the voltage across impedance R2.

2. A circuit arrangement as claimed in claim 1, wherein current sensor SE and impedance R2 are ohmic resistors.

3. A circuit arrangement as claimed in claim 1, wherein the means X comprise a bridge circuit.

4. A circuit arrangement as claimed in claim 1, wherein series circuit Y comprises no further components besides the first capacitive means C1 and the current sensor SE.

5. A circuit arrangement as claimed in claim 1, wherein branch C is in addition provided with an ohmic resistor R3.

6. A circuit arrangement as claimed in claim 1, wherein the means I are provided with means for generating a further signal which is a measure for an average value of the lamp current through generation of a time-averaged value of the signal generated by the means II.

7. A circuit arrangement as claimed in claim 2 wherein the means X comprise a bridge circuit.

8. A circuit arrangement as claimed in claim 2, wherein series circuit Y comprises no further components besides the first capacitive means C1 and the current sensor SE.

9. A circuit arrangement as claimed in claim 3, wherein series circuit Y comprises no further components besides the first capacitive means C1 and the current sensor SE.

10. A circuit arrangement as claimed in claim 7, wherein series circuit Y comprises no further components besides the first capacitive means C1 and the current sensor SE.

11. A circuit arrangement as claimed in claim 2, wherein branch C is in addition provided with an ohmic resistor R3.

12. A circuit arrangement as claimed in claim 3, wherein branch C is in addition provided with an ohmic resistor R3.

13. A circuit arrangement as claimed in claim 4, wherein branch C is in addition provided with an ohmic resistor R3.

14. A circuit arrangement as claimed in claim 7, wherein branch C is in addition provided with an ohmic resistor R3.

15. A circuit arrangement as claimed in claim 10, wherein branch C is in addition provided with an ohmic resistor R3.

16. A circuit arrangement as claimed in claim 2, wherein the means I are provided with means for generating a further signal which is a measure for an average value of the lamp current through generation of a time-averaged value of the signal generated by the means II.

17. A circuit arrangement as claimed in claim 3, wherein the means I are provided with means for generating a further signal which is a measure for an average value of the lamp current through generation of a time-averaged value of the signal generated by the means II.

18. A circuit arrangement as claimed in claim 4, wherein the means I are provided with means for generating a further signal which is a measure for an average value of the lamp current through generation of a time-averaged value of the signal generated by the means II.

19. A circuit arrangement as claimed in claim 5, wherein the means I are provided with means for generating a further signal which is a measure for an average value of the lamp current through generation of a time-averaged value of the signal generated by the means II.

20. A circuit arrangement as claimed in claim 15, wherein the means I are provided with means for generating a further signal which is a measure for an average value of the lamp current through generation of a time-averaged value of the signal generated by the means II.

* * * * *